US005890887A

United States Patent [19]

Adler

[11] Patent Number: 5,890,887

[45] Date of Patent: Apr. 6, 1999

[54] BUTANE APPLIANCE WITH PRESSURE VESSEL

[75] Inventor: R. Michael Adler, Guilford, Conn.

[73] Assignee: Kenyon Marine, Inc., Guilford, Conn.

[21] Appl. No.: 696,576

[22] Filed: Aug. 16, 1996

[51] Int. Cl.[6] ..... F24C 5/20

[52] U.S. Cl. ..... 431/344; 126/38; 126/39 R; 222/724

[58] Field of Search ..... 431/344, 142, 431/143; 222/1, 5; 220/724; 126/38, 39 R

[56] References Cited

U.S. PATENT DOCUMENTS

| | | | |
|---|---|---|---|
| 3,608,538 | 9/1971 | Guerrero | 126/38 |
| 3,907,490 | 9/1975 | Schaller | 126/38 |
| 4,122,764 | 10/1978 | D'Ambra | 126/38 |
| 4,392,449 | 7/1983 | Dining | 114/343 |
| 4,478,345 | 10/1984 | Edinger | 220/724 |

FOREIGN PATENT DOCUMENTS

| | | | |
|---|---|---|---|
| 0202921 | 9/1987 | Japan | 431/344 |

*Primary Examiner*—Carl D. Price
*Attorney, Agent, or Firm*—Morrison Law Firm

[57] ABSTRACT

A butane stove or heater includes a pressure vessel adapted to receive a conventional aerosol-type fuel container. The pressure vessel has a fuel conduit, connected to a pressure regulator and thence to the appliance burner unit, which is adapted for connection with a fuel container disposed therein, and a vent conduit which is adapted to vent any fuel escaping from the fuel container to a location remote from the appliance.

16 Claims, 12 Drawing Sheets

BUTANE APPLIANCE WITH PRESSURE VESSEL

FIELD OF THE INVENTION

This invention pertains to combustion appliances, particularly stoves and heaters, which utilize liquified gaseous fuel, such as propane, butane or mixtures thereof, stored in disposable containers. More particularly, it pertains to such appliances wherein the fuel container is mounted within the appliance itself and especially to such appliances intended for use aboard boats.

BACKGROUND

Small, single burner portable stoves ("cookers") using butane or butane/propane mixtures have become increasingly widely used. Such cookers use a standard disposable thinwalled "aerosol type" canister containing approximately 8 ounces of liquified fuel at a pressure that varies with ambient temperature. The canister is equipped with a spring-loaded pinvalve which, when depressed, permits gaseous fuel to be ejected. An orienting slot in the canister body cooperates with an aligning member on the pressure regulator to ensure that an internal canister standpipe is nominally vertical when the appliance is in use, thereby permitting only gaseous, not liquid, fuel to be ejected.

The gas canister in such a portable cooker is generally contained in an accessible, ventilated, lidded compartment within the cooker, approximately 4 inches from the burner itself. After being placed in position, the fuel canister is forcibly inserted into the pressure regulator inlet by means of a user-operated lever and associated linkage.

These cookers are typically inexpensively constructed and intended for portable use. Their general design and construction renders them extremely susceptible to misuse and abuse. Gas leakages and resulting flames frequently occur at the pressure regulator or at the canister-regulator interface.

Within the last several years, such cookers have increasingly begun to appear aboard pleasure boats, particularly aboard small powerboats wherein permanently built-in cooking appliances are often not provided. Because a small boat includes many closed spaces, such as bilges and the engine compartment, and because butane/propane mixtures are heavier than air, there is a concern that fuel leaking from the stove, fuel canister or both, will be ignited by one of the many potential ignition sources commonly found aboard such craft. The greatest hazard, however, is the abuse-to-failure of the thinwalled fuel canister itself while it is in actual use within the cooker. Such abuse is encouraged by the design of these portable cookers, such that it is very easy for an unwary user to create conditions in which the canister can and will rupture, often with serious consequences.

At the same time, it is to be noted that one type of cooking appliance, using compressed or liquified gas, has been used aboard thousands of pleasure boats for decades and has compiled an admirable safety record. In these appliances, the fuel canister is not housed within the appliance itself. Rather, the fuel canister, or canisters, is typically contained within a remotely located dedicated compartment which opens only to the outside deck, is isolated by gastight seals from all of the interior spaces of the boat, and is vented overboard so that accidental gas leakages are harmlessly discharged into open air. A supply pipe connects to the cooking appliance via a valve, inside the housing, which is controlled by a switch located near the appliance. The user thereby controls the fuel supply, shutting it off after use.

Unfortunately, these installations are large, heavy, costly and thus are limited to use in larger craft.

OBJECTS AND SUMMARY OF THE INVENTION

It is a primary object of the present invention to provide an improved combustion appliance, of the type utilizing liquified gaseous fuel, suitable for use in small boats, campers, trailers and similar applications, which overcomes the defects of existing portable appliances and is safe in use; more specifically, one which provides the same degree of safety as the above-mentioned installations on larger boats.

It is a further object to provide a combustion appliance as aforesaid which is compact, easy to install and convenient to use.

The foregoing and other objects and advantages as may hereinafter appear are achieved by a combustion appliance, of the type fueled by propane, butane or mixtures thereof stored in a disposable aerosol-type container, which includes a pressure vessel adapted to receive the fuel container. The pressure vessel has a fuel conduit, connecting to a pressure regulator and thence to the appliance burner unit, which is adapted for connection with a fuel container disposed therein, and a vent conduit which is adapted to vent any fuel escaping from the fuel container to a location remote from the combustion appliance.

According to an aspect of the invention, the appliance includes a base portion adapted to be fixedly attached to a supporting work surface and the pressure vessel may be hingedly carried by the appliance base portion for rotation between a first position, entirely below the supporting work surface, and a second position, whereat a portion of the pressure vessel projects above the work surface such that a fuel container may be inserted thereinto or removed therefrom.

According to another aspect of the invention, the fuel conduit may be provided with a shut-off system, which prevents fuel from exiting the pressure vessel unless the pressure vessel is in its first position.

DESCRIPTION OF THE PREFERRED EMBODIMENTS

Figures 1A, 1B:
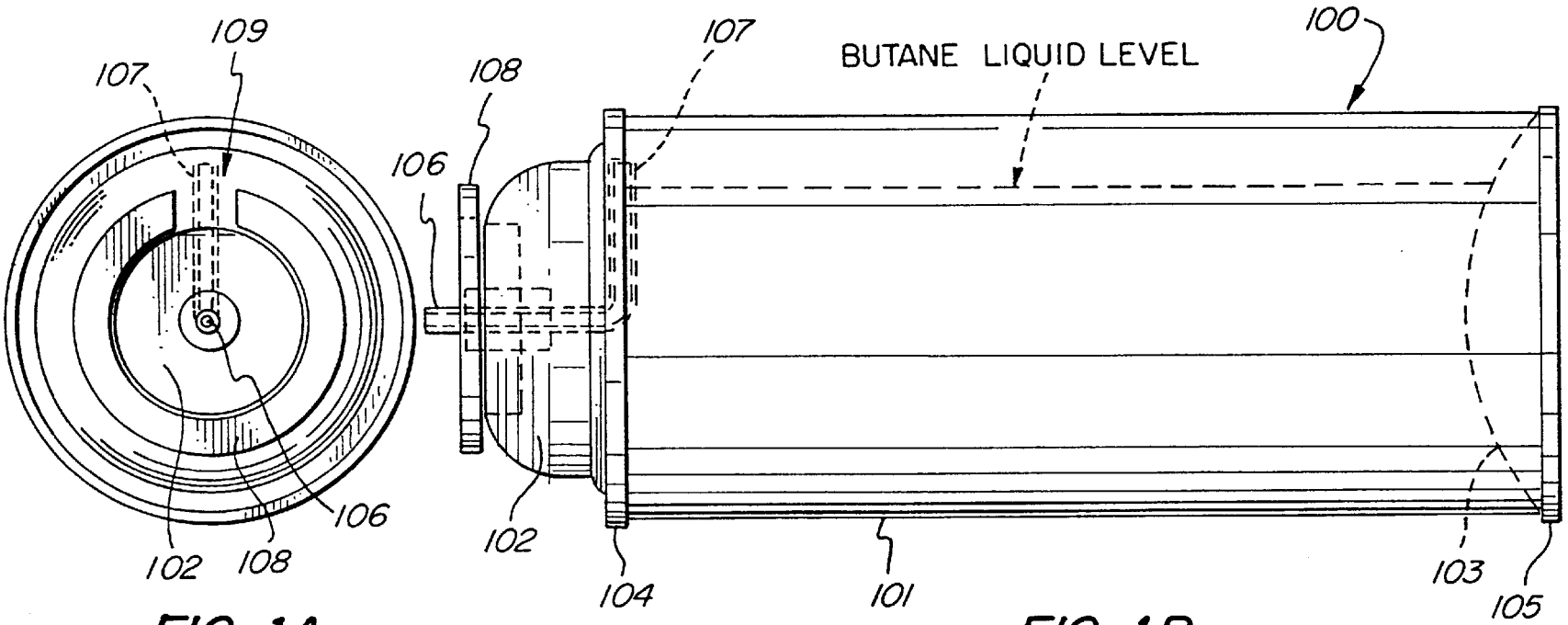
FIG. 1A is a top plan view of a butane fuel canister.
FIG. 1B is a side elevation view of the fuel canister of FIG. 1A.

In FIGS. 1A and 1B, there is shown a standard disposable thinwalled "aerosol type" canister 100 containing approximately 8 ounces of liquified butane. Canister 100 includes a cylindrical canister body 101, a domed closure 102 and a concave closure 103. Closures 102 and 103 are joined to canister body 101 by lapped folds 104 and 105 respectively. A valve assembly, including a springloaded pinvalve 106, fixed in the center of domed closure 102, is connected to a standpipe 107 disposed within canister body 101. Pinvalve 106 must be depressed, against the force of its internal spring, before fuel can flow from canister 100. An annular collar 108, encircling pinvalve 106, includes an orienting slot 109 which ensures, as will be hereinafter described, that standpipe 107 is nominally vertical and, thus, projecting above the surface of the liquid butane, when pinvalve 106 is opened, thereby permitting only gaseous, not liquid, fuel to be ejected.

Figure 2C:
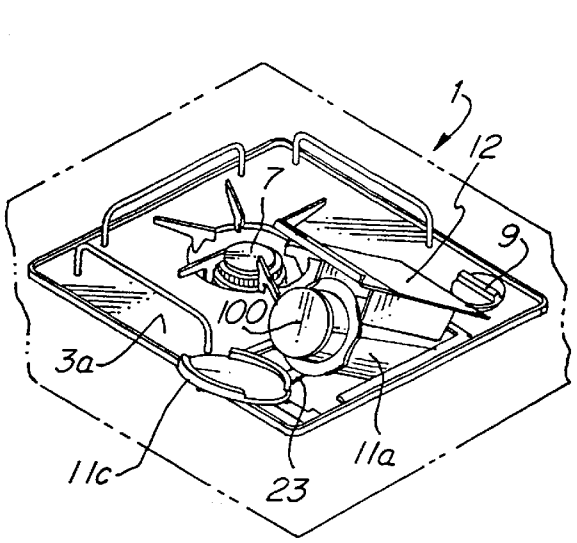
FIG. 2C is a perspective view of the cooker of FIGS. 2A and 2B, with the pressure vessel in the second position and open.
Figure 2B:
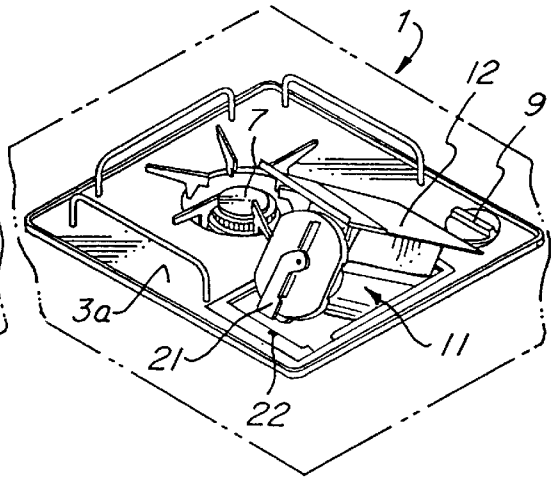
FIG. 2B is a perspective view of the cooker of FIG. 2A, with the pressure vessel in the second position and closed.
Figure 2A:
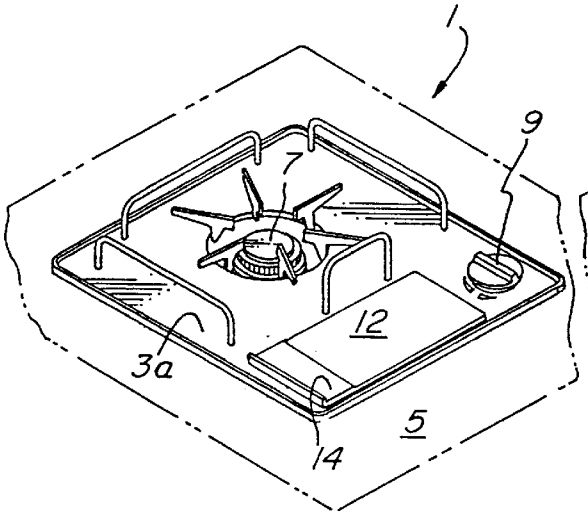
FIG. 2A is a perspective view of a cooker, in accord with the present invention, with the pressure vessel in, the first position.

Turning now to FIGS. 2A, 2B and 2C, there is seen a cooker 1, utilizing a fuel canister of the type shown in FIGS. 1A and 1B, comprising a base portion 3 fixedly attached to a supporting work surface 5. Base portion 3 has a substantially planar upper surface 3*a* which is disposed substantially flush to work surface 5. A burner unit 7 is located on upper surface 3*a* of base portion 3, as is burner control knob 9. A pressure vessel 11, adapted to receive a fuel canister 100, is hingedly carried (as will be more fully explained below) by base portion 3 for rotation between a first or operative position, shown in FIG. 2A, entirely beneath supporting work surface 5, and a second or loading position, whereat a portion projects above work surface 5, such that a fuel canister may be inserted thereinto or removed therefrom, shown in FIGS. 2B and 2C.

Figure 3:
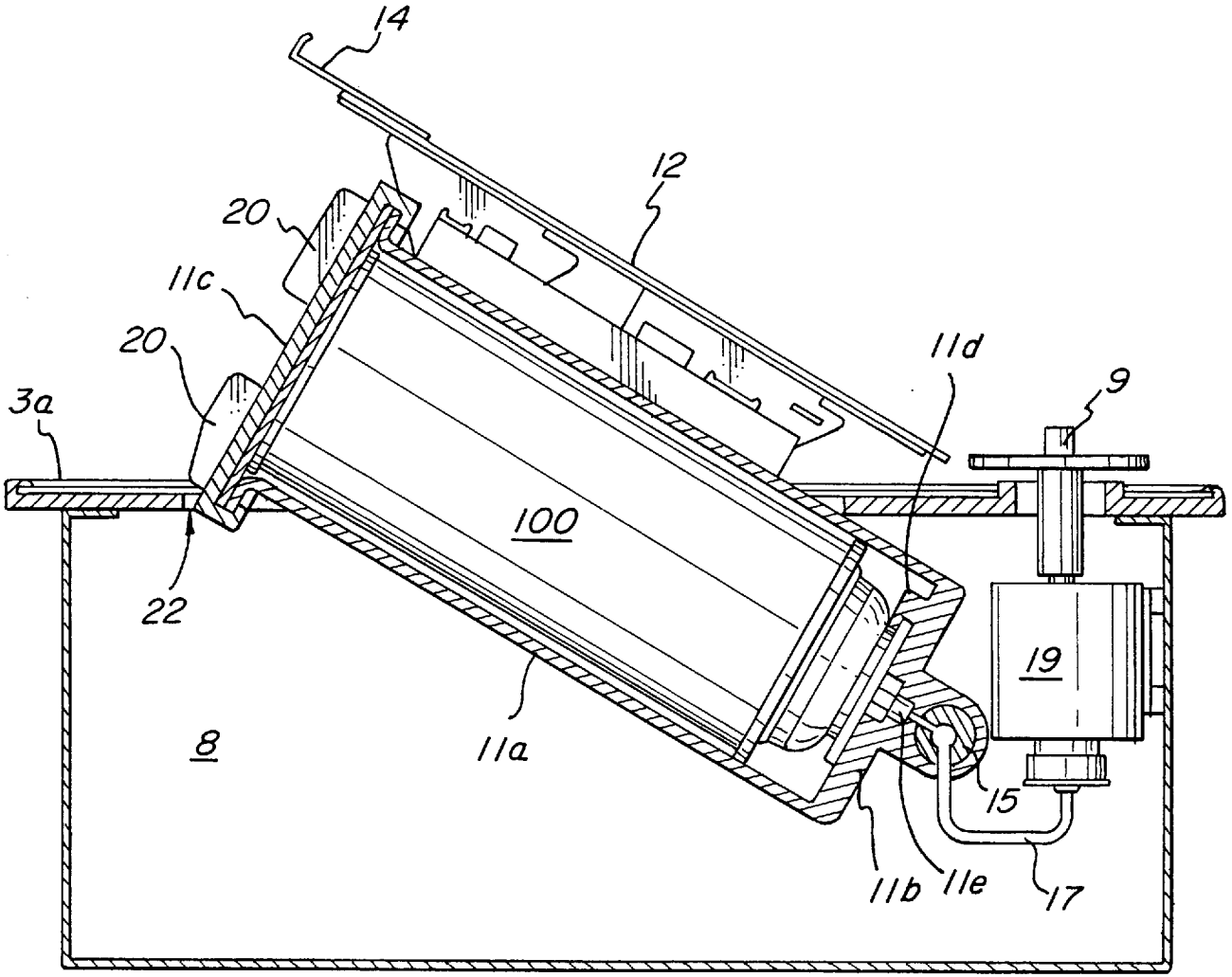
FIG. 3 is a cross-sectional view of the cooker of FIGS. 2A and 2B, in the position shown in FIG. 2B.

As best seen in FIG. 3, pressure vessel 11 includes a cylindrical body 11*a*, a fixed end portion 11*b*, and an openable or removable end cap 11*c* adapted for gas-tight closure of the vessel. A canister orienting member 11*d* is provided on the inside of body 11*a* to mate with orienting slot 109 in canister collar 108 to insure that the fuel canister standpipe 107 is nominally vertical. A canister docking member lie is disposed on the inside of fixed end portion 11*b*. Docking member lie receives the fuel canister valve assembly and provides for secure retention of the canister and positive depressing of pinvalve 106. When a fuel canister is placed within pressure vessel 11, and seated in docking member 11*e*, gaseous fuel will flow out therethrough from the canister into fuel conduit 17. It will be appreciated that canister 100 must be urged against docking member 11*e* to depress springloaded pinvalve 106 before fuel can exit the canister. Pressure vessel 11 provides for safe containment of the fuel, even in the event of a rupture of a fuel container therein.

Cover plate 12 is carried atop pressure vessel 11 which, in turn, is hingedly fixed to base portion 3 of cooker 1. When pressure vessel 11 is in the operative position, cover plate 12 is substantially coplanar with upper surface 3*a* of base portion 3 and is secured in place by latch 14. When latch 14 is opened, springs (not shown), in the hinge assembly, urge pressure vessel 11 toward the loading position.

Removable end cap 11*c* is provided with upstanding finger tabs 20 which facilitate attachment and removal of the end cap 11*c* from pressure vessel body 11*a*. Finger tabs 20 co-operate with a notch 22 in upper surface 3*a* of cooker base portion 3 such that lid 12 will close only if end cap 11*c* is properly secured. This also prevents end cap 11*c* from rotating while pressure vessel 11 is in the operative position, as may otherwise result from a boat's violent movements, shock or vibration. To prevent loss of end cap 11*c*, it is permanently fixed to body 11*a* by a short flexible strap 23. It will be noted that end cap 11*c* urges fuel canister 100 against docking member 11*e*. If the user omits to secure end cap 11*c* in place, pinvalve 106 will not be depressed and no fuel will flow from canister 100.

Figures 4A, 4B:
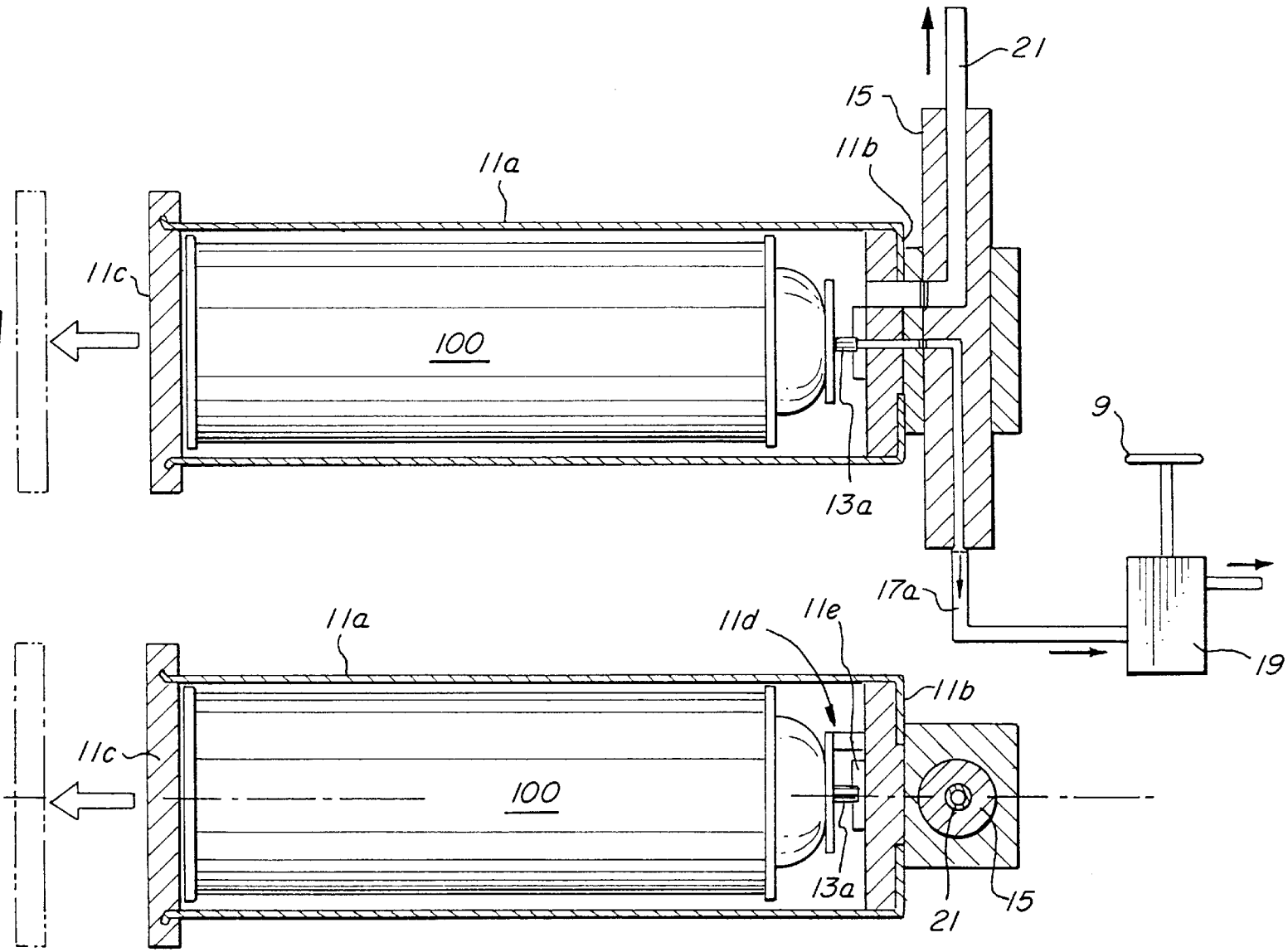
FIG. 4A is a simplified diagrammatic top cross-sectional view of the fuel system of the cooker of FIGS. 2 and 3.
FIG. 4B is a simplified diagrammatic side cross-sectional view of the fuel system of FIG. 4A.
Figure 5A:
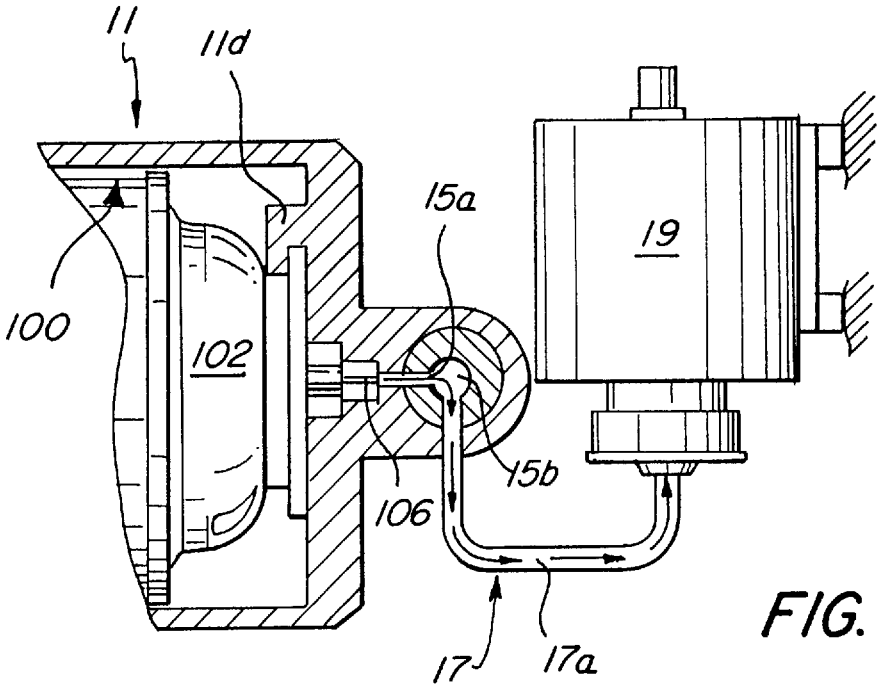
FIG. 5A is an enlarged fragmentary cross-sectional view of the pressure vessel of FIG. 3 in the first position.
Figure 5B:
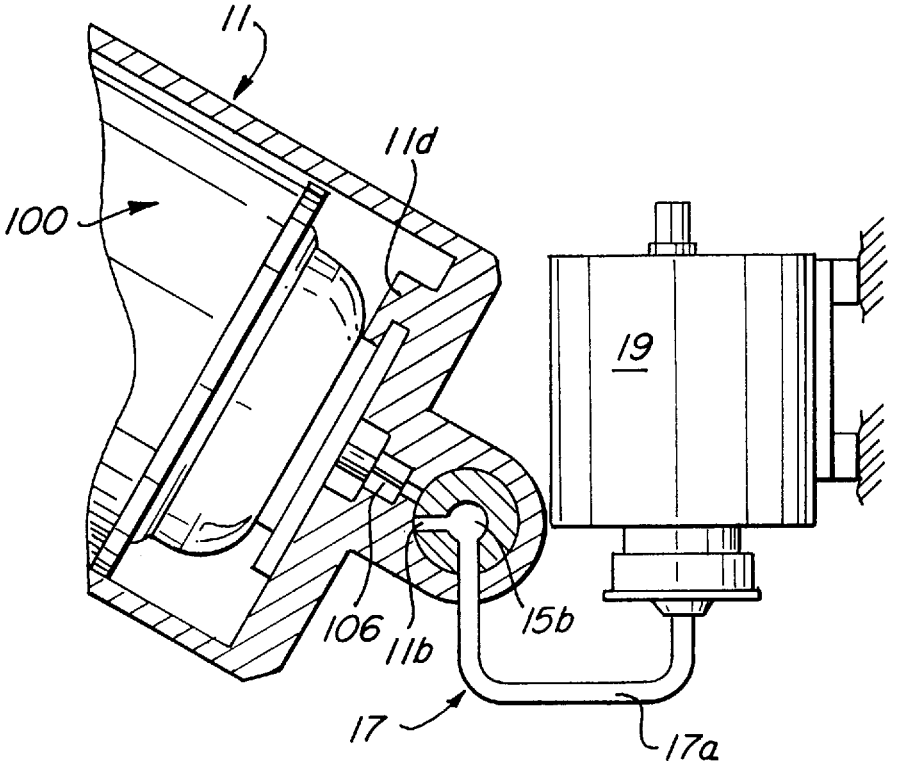
FIG. 5B is an enlarged fragmentary cross-sectional view of the pressure vessel of FIG. 3 in the second position.

As illustrated in FIGS. 4A and 4B, fixed end portion 11*b* of pressure vessel 11 is journaled on a stationary horizontal shaft 15 fixed in base portion 3 of cooker 1. Fuel conduit 17 connects fuel canister 100, within pressure vessel 11, to gas pressure regulator and control valve assembly 19. A vent conduit 21, connected to pressure vessel 11, is adapted to vent any fuel escaping from fuel canister 100 to a location remote from the cooker. In a marine application, this location is preferably exterior to the boat. Both fuel conduit 17 and vent conduit 21 pass through stationary shaft 15. Advantageously, the connection of fuel conduit 17 through shaft 15 is arranged such as to close the fuel passage when pressure vessel 11 is in the loading position and open it when pressure vessel 11 is in the operative position. This fuel conduit arrangement is illustrated in FIGS. 5A and 5B. A port 15*a* is formed in stationary shaft 15, communicating with an axial bore 15*b*, which, in turn, communicates with a fuel hose 17*a*. Port 15*a*, is positioned to align with the outlet of docking member 11*e* of pressure vessel 11, when the pressure vessel is in the first position (FIG. 5A), so as to receive gaseous fuel from fuel canister 100. When pressure vessel 11 is in the second position (FIG. 5B), port 15*c* is occluded and fuel flow is cut off.

Figure 6A:
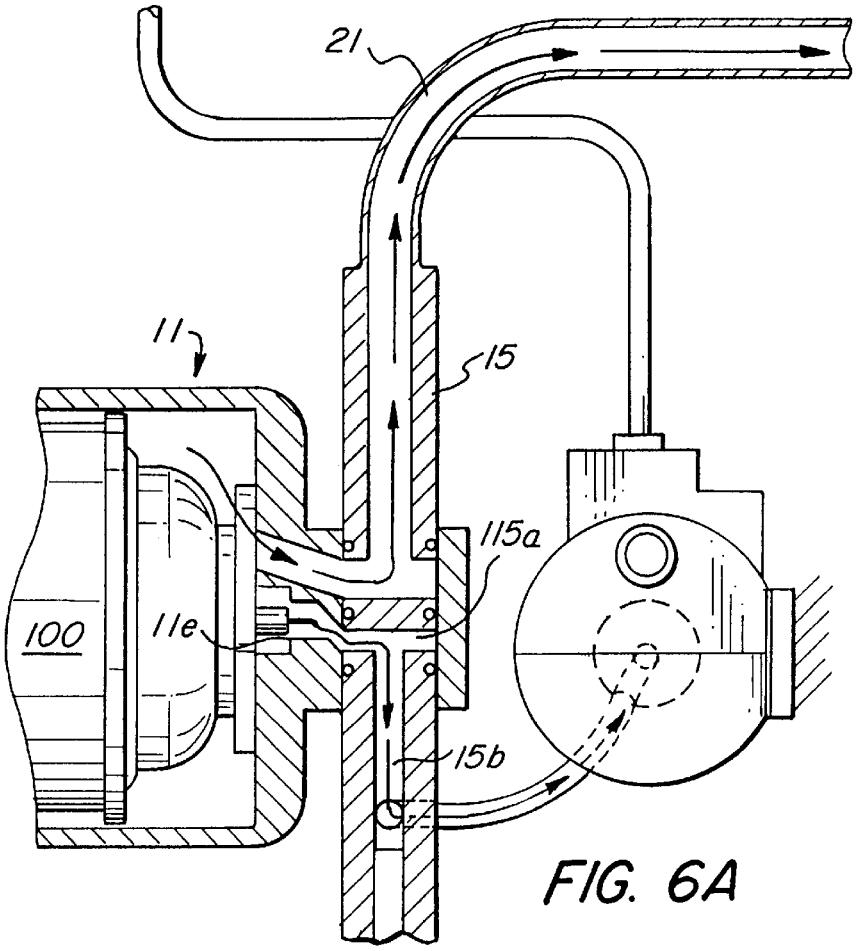
FIG. 6A is an enlarged fragmentary cross-sectional view of the pressure vessel of FIG. 3 in the first position, with an alternate arrangement of the fuel conduit and the vent conduit.
Figure 6B:
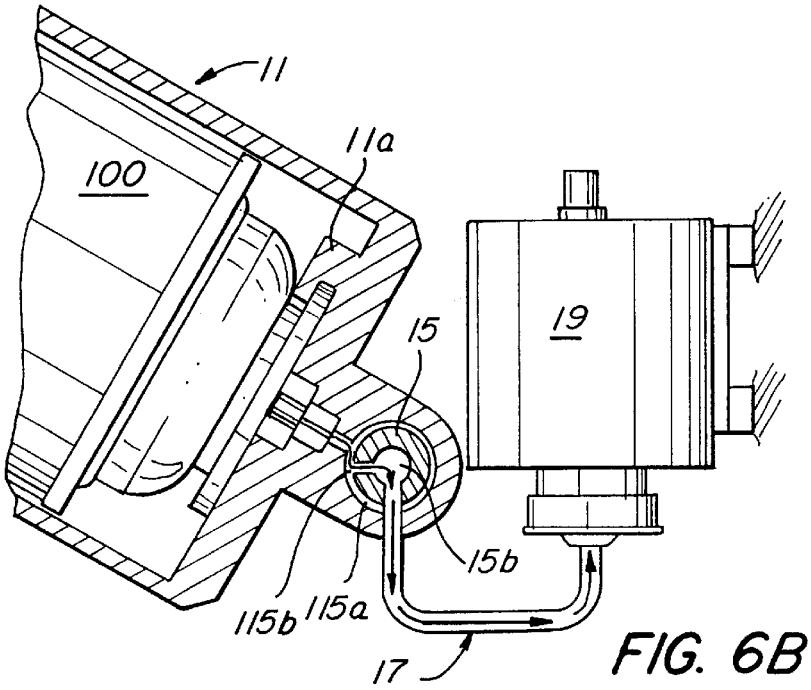
FIG. 6B is an enlarged fragmentary cross-sectional view of the structure of FIG. 6A, with the pressure vessel in the second position.

An alternate fuel conduit arrangement, illustrated in FIGS. 6A and 6B, adds an annular groove 115*a*, in stationary shaft 15, which communicates with both docking member 11*e* of pressure vessel 11 and a secondary port 115*b*. Secondary port 115*b*, in turn, opens into axial bore 15*b*. This arrangement does not prevent fuel flow when pressure vessel 11 is in the second position. Vent conduit 21 is arranged substantially identically to this fuel conduit arrangement.

Figure 7A:
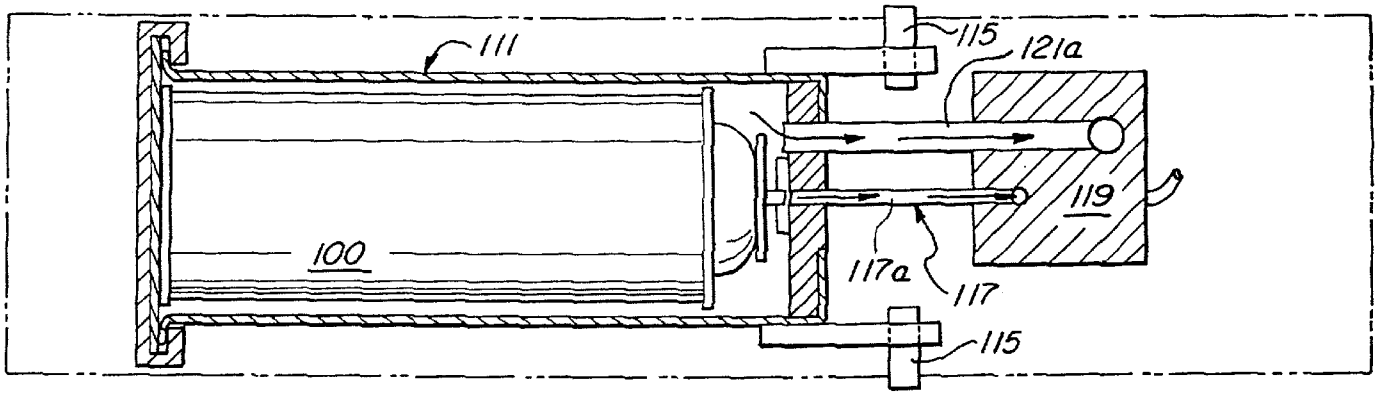
FIG. 7A is a simplified diagrammatic top cross-sectional view of an alternate embodiment of a fuel system of a cooker in accord with the present invention.
Figure 7B:
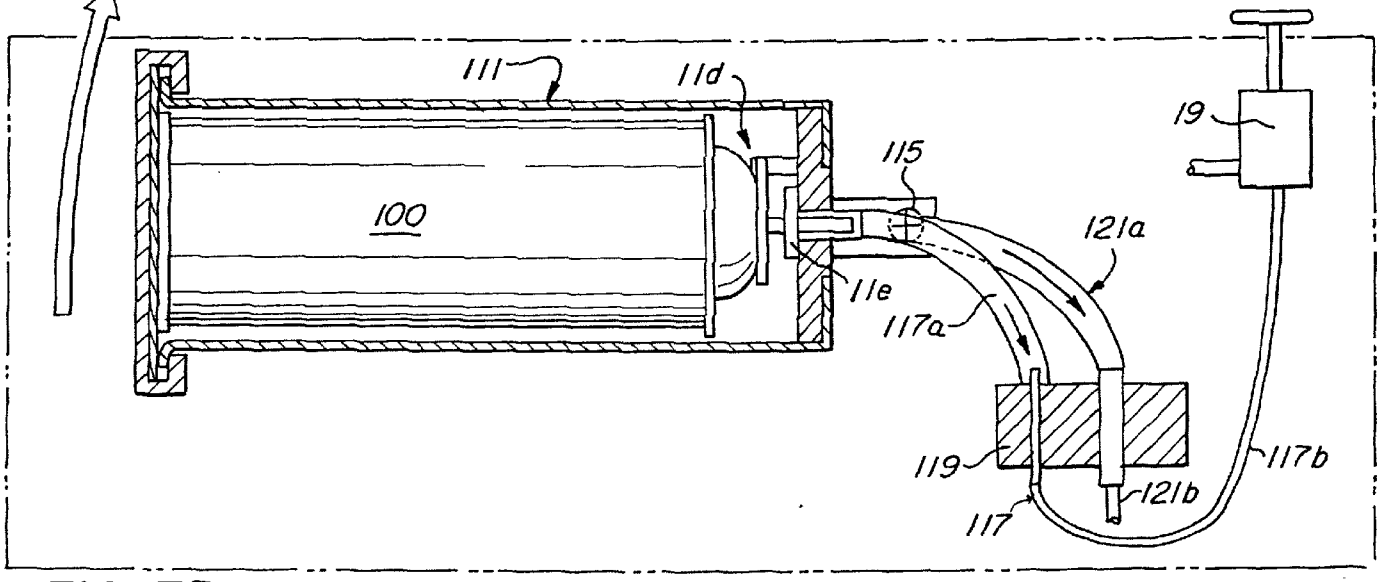
FIG. 7B is a simplified diagrammatic side cross-sectional view of the fuel system of FIG. 7A.

Turning now to FIGS. 7A and 7B, there is illustrated an alternate arrangement of the fuel system, comprising pressure vessel 111, fuel conduit 117 and vent conduit 121. Pressure vessel 111 is hingedly carried on two diametrically opposed horizontal hinge pins 115 fixed in base portion 3 of cooker 1. Fuel conduit 117 and vent conduit 121 each include two pipe portions, a first pipe portion 117*a* and 121*a* respectively, which is formed of a flexible tubing material, and a second, inflexible pipe portion 117*b* and 121*b* respectively. First pipe portions 117*a* and 121*a* connect pressure vessel 111 to a stationary termination block 119 fixed to base portion 3 of cooker 1. Second pipe portions 117*b* and 121*b*, in turn, connect termination block 119 to gas pressure regulator and control valve 19 and the gas exhaust outlet (not shown) respectively. It will be appreciated that flexible pipe portions 117*a* and 121*a* allow pressure vessel 111 to be rotated or pivoted about hinge pins 115 between operative and loading positions.

Figure 8:
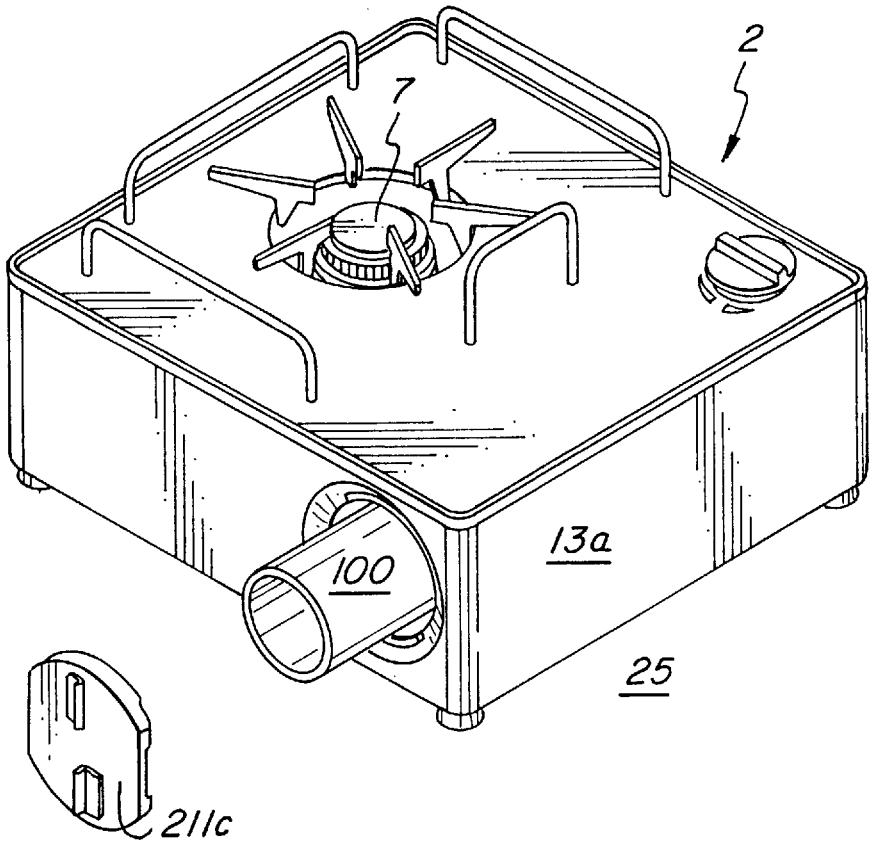
FIG. 8 is a perspective view of another embodiment of a cooker in accord with the present invention.
Figure 9:
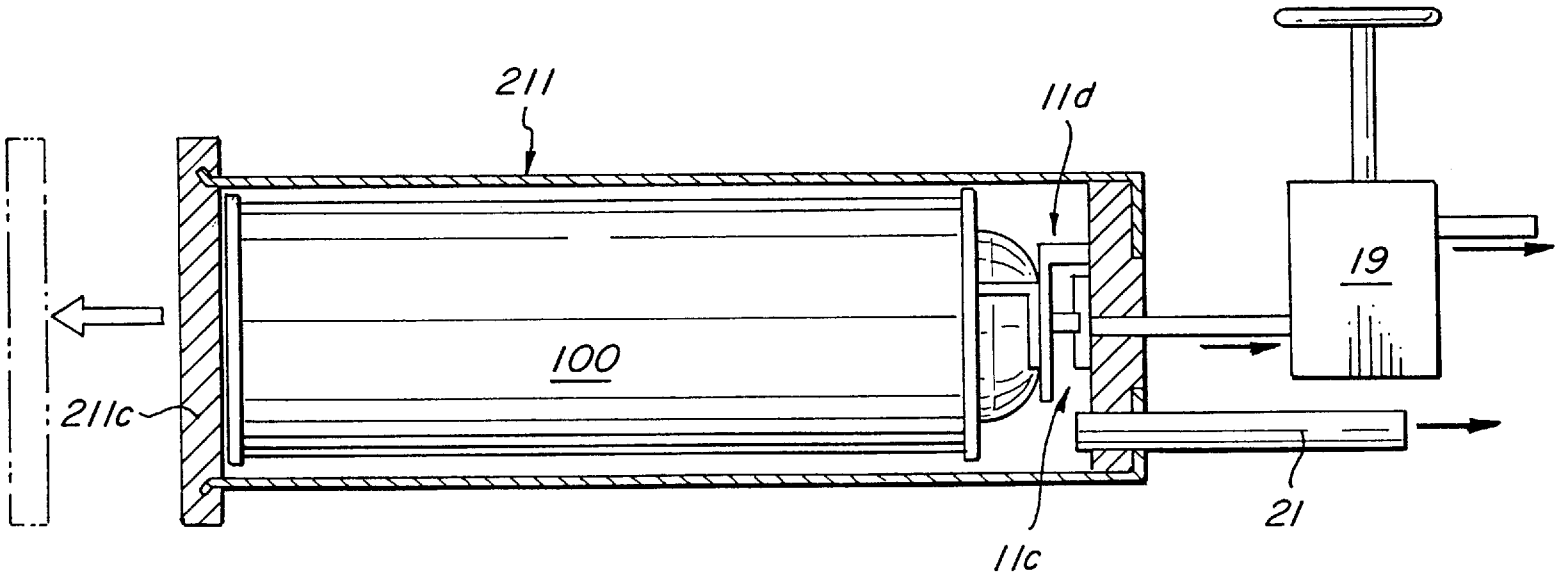
FIG. 9 is a simplified side cross-sectional view of the fuel system of the cooker of FIG. 8.

In FIGS. 8 and 9, there is seen another embodiment of a cooker 2 which is affixed to and rests atop a work surface 25. In this embodiment, the pressure vessel 211 is fixed in a horizontal position in the base portion 13*a* of the cooker, with the removable end cap 211*c* exposed so as to permit the ready insertion or replacement of a fuel canister 100.

Figure 10:
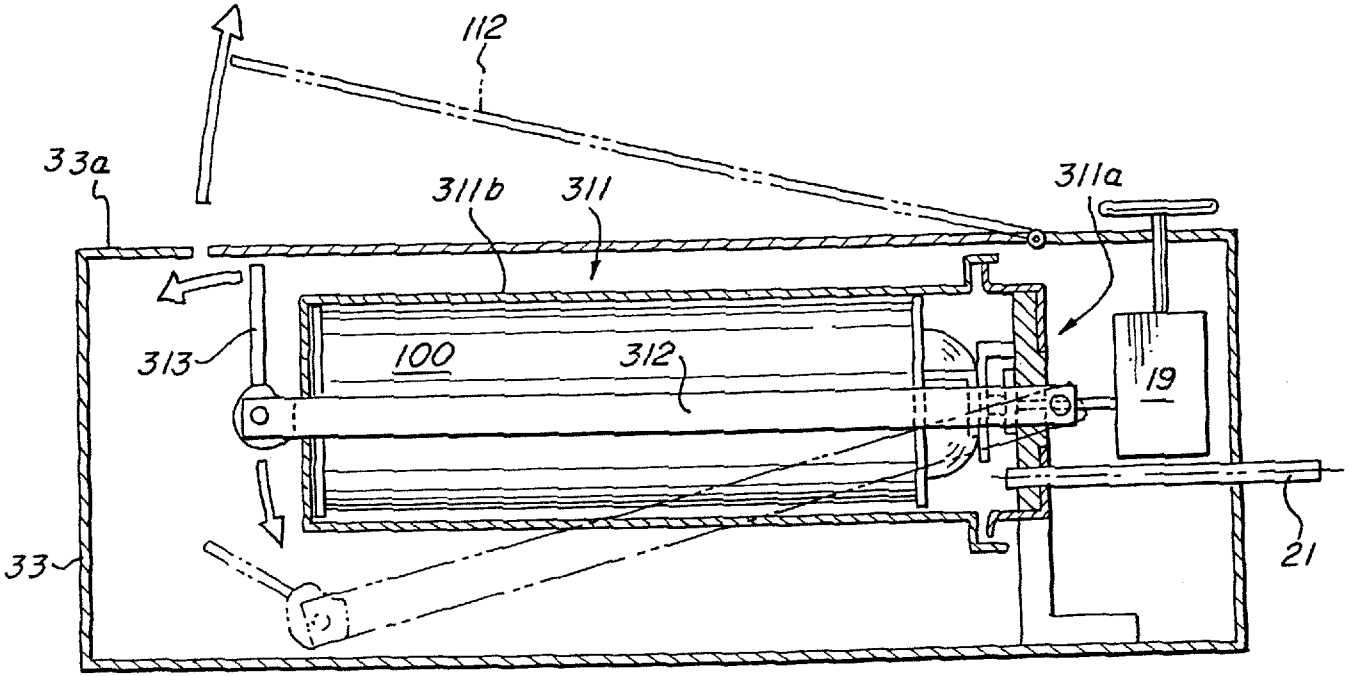
FIG. 10 is a simplified diagrammatic side cross-sectional view of yet another alternate embodiment of a fuel system of a cooker in accord with the present invention.

Turning now to FIG. 10, there is seen yet another fuel system, wherein a pressure vessel 311 is fixed, in a horizontal position in base portion 33 of the cooker. As in previously described embodiments, base portion 33 includes an upper surface 33*a* which is flush with the surrounding work surface (not shown). Cover plate 112, hinged to base portion 33, provides access to pressure vessel 311.

Pressure vessel 311 comprises an end portion 311*a*, which includes canister orienting and docking members as above, and a cylindrical body portion 311*b* with an integral bottom. Body portion 311*b* is abuttingly secured against end portion 311*a* by a yoke 312 and cam lever 313. It will be appreciated that release of yoke 312 and cam lever 313 allows separation of pressure vessel body portion 311*b* from end portion 311*a*, permitting insertion or replacement of a fuel canister. It will be further appreciated that, unless body portion 311*b* is properly secured in position, a fuel canister will not remain engaged with the fuel docking member on end portion 311*a* and the cooker can not be operated.

Figure 11:
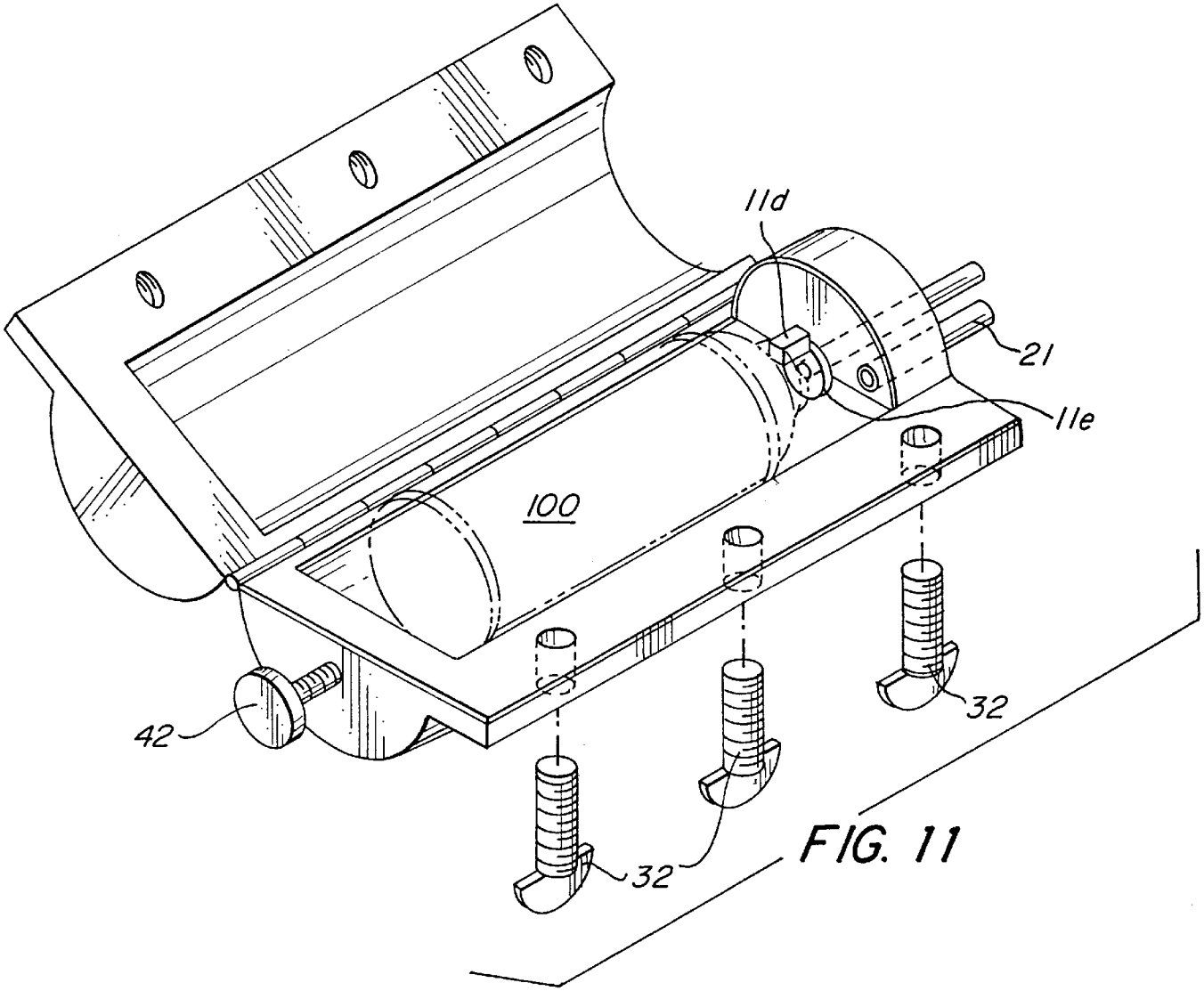
FIG. 11 is a perspective view of an alternate form of pressure vessel.
Figure 12:
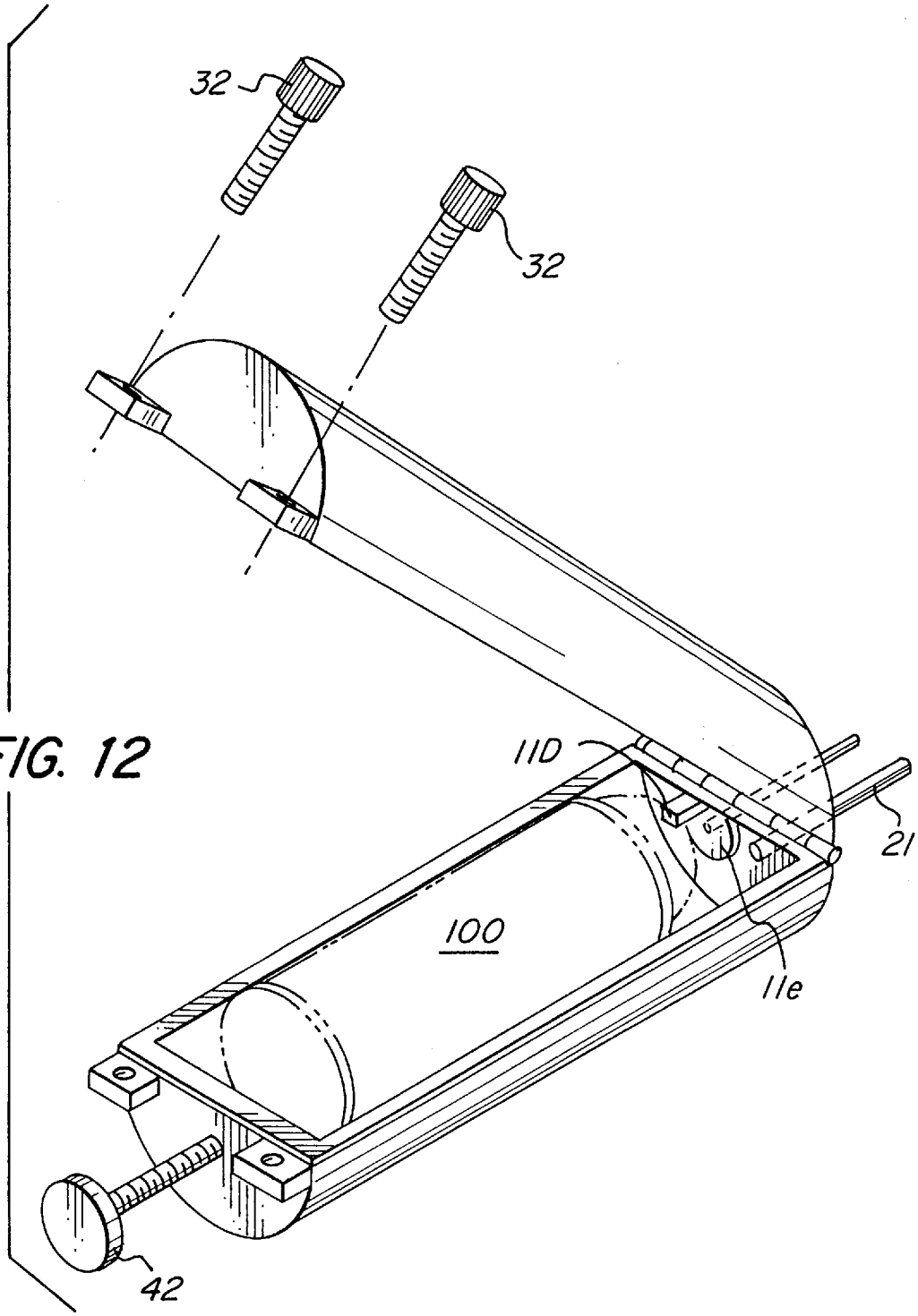
FIG. 12 is a perspective view of another alternate form of pressure vessel.

In FIGS. 11 and 12, there are shown alternate embodiments of a stationary pressure vessel for use in a cooker arranged like that illustrated diagrammatically in FIG. 10. In these embodiments, the body of the pressure vessel is essentially divided into axially extending separable halves which are advantageously hingedly connected. Suitable gasketing material (not shown) is provided on the mating surfaces of the vessel so as to establish a gas-tight fit when the halves are closed. Thumbscrews 32 are used to draw together and secure the vessel halves. An axially directed thumbscrew 42, disposed in the base of the pressure vessel, is used to hold a fuel canister in position on the fuel docking member.

It will be appreciated that a purpose of the pressure vessel is to safely contain a burst fuel canister, and its contents, in the event of a rupture. At an ambient pressure of 86° F., the internal pressure of a typical fuel canister, such as the one illustrated in FIGS. 1A and 1B, is about 35 p.s.i.g. Such canisters are designed to maintain their integrity to a pressure of 180 p.s.i.g. Experiments have shown that the canister top typically begins to buckle at a pressure of 190 p.s.i.g., with rupture occurring, in an unrestrained canister, at pressures between 190 and 270 p.s.i.g.

When a canister was secured within a pressure vessel, with a vent conduit of ⅜ inch diameter, 12 feet in length, the maximum pressure measured in the vessel was 150 p.s.i.g. The pressure vessel, therefore, is designed and constructed to withstand this pressure, increased by a suitable safety factor.

While the present invention has been described with reference to the preferred embodiments, it is to be understood that various changes and modifications can be made thereto without departing from the spirit and contemplation of the invention, which are intended to be limited in scope only by the following claims. In particular, it is to be understood that the present invention may be used with all types of containers of liquified or compressed petroleum gas. Likewise, it is to be understood that it is applicable to all types of combustion appliances, includng, for example, heaters.

What is claimed is:

1. In a combustion appliance wherein the fuel is contained in a disposable container of propane, butane or mixtures thereof, the improvement comprising:

a pressure vessel adapted to receive a disposable fuel container, said pressure vessel being equipped with a fuel conduit connecting to a burner unit, said fuel conduit being adapted for connection with a fuel container disposed within said pressure vessel, and a vent conduit, said vent conduit being adapted to vent any fuel escaping from the fuel container to a location remote from the combustion appliance.

2. The improved combustion appliance of claim 1, wherein said appliance includes a base portion adapted to rest atop a work surface, said base portion including at least one substantially vertical surface; said pressure vessel comprising a substantially cylindrical member including a removable end cap, said pressure vessel being fixed in said base portion with said end cap protruding from said at least one vertical surface such that a fuel container may be inserted into said pressure vessel or removed therefrom.

3. The improved combustion appliance of claim 1, wherein said pressure vessel is a substantially cylindrical member including a removable end cap adapted to permit the insertion of a fuel container into said pressure vessel, said removable end cap being adapted to urge a fuel container in said pressure vessel toward said fuel conduit.

4. In a combustion appliance wherein the fuel is contained in a disposable container of propane, butane or mixtures thereof, the improvement comprising:

a pressure vessel adapted to receive a disposable fuel container, said pressure vessel being equipped with a fuel conduit connecting to a burner unit, said fuel conduit being adapted for connection with a fuel container disposed within said pressure vessel, and a vent conduit, said vent conduit being adapted to vent any fuel escaping from the fuel container to a location remote from the combustion appliance;

said appliance including a base portion having an upper surface including a cover plate, said pressure vessel being fixed in said base portion, said cover plate being openable to provide user access to said pressure vessel.

5. The improved combustion appliance of claim 4, wherein said pressure vessel includes a substantially cylindrical body, said body being divided into two axially extending parts which are separable so as to permit the insertion of a fuel container into said pressure vessel.

6. The improved combustion appliance of claim 4, wherein said pressure vessel includes a substantially cylindrical body, said body being divided into two parts so as to permit the insertion of a fuel container into said pressure vessel, and said combustion appliance further including a yoke and cam lever adapted to hold said body parts in abutting relation.

7. In a combustion appliance wherein the fuel is contained in a disposable container of propane, butane or mixtures thereof, the improvement comprising:

a pressure vessel adapted to receive a disposable fuel conduit connecting to a burner unit, said fuel conduit being adapted for connection with a fuel container disposed within said pressure vessel, and a vent conduit, said vent conduit being adapted to vent any fuel escaping from the fuel container to a location remote from the combustion appliance;

said appliance including a base portion, said base portion having an upper surface, said upper surface including a cover plate giving access into said base portion, said pressure vessel being hingedly carried by said base portion for rotation between a first position entirely beneath said upper surface, and a second position whereat a portion of said pressure vessel projects through said cover plate such that a fuel container may be inserted into said pressure vessel or removed therefrom.

8. The improved combustion appliance of claim 7, wherein said fuel conduit and said fuel vent include flexible pipe members.

9. The improved combustion appliance of claim 7, wherein said pressure vessel rotates about a portion of at least one of said fuel conduit and said vent conduit.

10. An improved cooker, fueled by propane, butane or mixtures thereof, stored in a pressurized container, said cooker comprising:

a. a base portion having a substantially planar upper surface, said base portion being adapted to be fixedly attached to a supporting work surface with said upper surface substantially flush to said work surface;

b. at least one burner unit mounted on said upper surface of said base portion;

c. a pressure vessel adapted to receive a pressurized fuel container, said pressure vessel being hingedly carried by said base portion for rotation between a first position entirely beneath the supporting work surface, and a second position whereat a portion of said pressure vessel projects above the work surface such that a fuel container may be inserted thereinto or removed therefrom;

d. a fuel conduit, fixed to said pressure vessel, for connection with a fuel container disposed therein, said fuel container being operatively connected to said at least one burner unit; and e. a fuel vent, fixed to said pressure vessel, adapted to vent any fuel escaping from a fuel container therein to a location remote from said cooker.

11. The cooker of claim 10, further comprising at least one burner control knob operatively associated with said at least one burner unit, said at least one burner control knob being mounted on said upper surface of said base portion.

12. The cooker of claim 10, wherein said fuel conduit and said fuel vent include flexible pipe members.

13. The cooker of claim 10, further comprising means closing said fuel conduit when said pressure vessel is moved from said first position to said second position.

14. The cooker of claim 10, wherein said pressure vessel is a substantially cylindrical member including a removable end cap adapted to permit the insertion of a fuel container into said pressure vessel.

15. The cooker of claim 14, wherein said removable end cap is adapted to urge a fuel container in said pressure vessel toward said fuel conduit, said end cap including at least one upstanding finger tab, said at least one finger tab co-operating with said upper surface of said base portion to prevent rotation of said pressure vessel to said first position unless said end cap is properly secured thereon.

16. The cooker of claim 10, wherein said pressure vessel rotates about a portion of at least one of said fuel conduit and said vent conduit.

* * * * *